United States Patent [19]

Anne

[11] 4,413,898

[45] Nov. 8, 1983

[54] PHOTOELECTROPHORETIC DUPLEX IMAGING APPARATUS AND METHOD

[75] Inventor: Raymond E. Anne, Caledonia, N.Y.

[73] Assignee: Eastman Kodak Company, Rochester, N.Y.

[21] Appl. No.: 379,380

[22] Filed: May 17, 1982

[51] Int. Cl.[3] ..... G03G 15/24

[52] U.S. Cl. ..... 355/3 P; 355/24; 355/77; 430/32

[58] Field of Search ..... 355/3 P, 23, 24, 26, 355/14 R, 3 R, 77; 430/32

[56] References Cited

U.S. PATENT DOCUMENTS

| | | | |
|---|---|---|---|
| 3,318,212 | 5/1967 | Rubin | 95/1.7 |
| 3,671,118 | 6/1972 | Fantuzzo et al. | 355/26 X |
| 3,694,073 | 9/1972 | Bhagat | 355/26 X |
| 3,697,171 | 10/1972 | Sullivan | 355/24 X |
| 3,734,015 | 5/1973 | Camis et al. | 101/229 |
| 3,775,102 | 11/1973 | Punnett | 96/1 R |
| 3,844,653 | 10/1974 | Kelly | 355/8 |
| 4,084,896 | 4/1978 | Warter et al. | 355/3 P |
| 4,167,323 | 9/1979 | Hage | 355/3 R |

*Primary Examiner*—R. L. Moses

*Attorney, Agent, or Firm*—John D. Husser

[57] ABSTRACT

Duplex photoelectrophoretic imaging is implemented with apparatus of the kind having first and second electrodes movable along respective endless paths and cooperatively forming an imaging nip by: (1) first forming a first suspension image on the first electrode and (2) then feeding a copy sheet into the imaging nip and forming a second suspension image on one side of the copy sheet while transferring the first suspension image to the other side of the copy sheet.

4 Claims, 4 Drawing Figures

PHOTOELECTROPHORETIC DUPLEX IMAGING APPARATUS AND METHOD

BACKGROUND OF THE INVENTION

1. Field of the Invention

The present invention relates to photoelectrophoretic imaging and more particularly to configurations and procedures for use in photoelectrophoretic imaging to provide duplex copy sheets (i.e. copies which have images on both sides of the sheet).

2. Description of Prior Art

Photoelectrophoretic imaging involves the exposure of a suspension, containing electrophotosensitive marking particles in a carrier liquid, to a light image while in the presence of a migration inducing electrical field (usually provided by sandwiching electrodes). In response to the imaging exposure, particles within the suspension migrate to form corresponding image patterns on the electrode surfaces (e.g. a negative sense image on what has been termed an "injecting" electrode and a positive sense image on what has been termed a "blocking" electrode). In the usual imaging technique the desired image is transferred from its electrode to a receiver sheet and fixed by heating and/or pressure. For color imaging the suspension contains different color particles (with respectively different electrophotosensitivities) and the exposing image is a color negative or positive.

The most common configuration proposed for automated photoelectrophoretic imaging involves opposed cylindrical electrodes forming an imaging nip where a light image is strip scanned onto suspension within the nip in synchronization with the rotation of the cylindrical electrodes. The desired image is transferred to a receiver at a location downstream from the imaging nip. In some configurations (usually in neg.-pos. imaging) a receiver is attached to one electrode (usually the blocking electrode); and the image is formed directly on the receiver, which is subsequently separated from the electrode.

For certain applications, e.g. brochures and advertising literature, it is desirable to provide images on both sides of a copy sheet, i.e. duplex copy sheets.

SUMMARY OF THE INVENTION

One purpose of the present invention is to provide improved photoelectrophoretic apparatus and method for producing duplex copy sheets. A significant advantage of methods and apparatus in accordance with the present invention is that duplex copies can be produced with a single pass of the copy sheet through the imaging station. Another advantage of the present invention is that its implementation is structurally and functionally simple.

The objectives and advantages of the present invention are accomplished with rotatable donor and receiver electrodes disposed to form an imaging nip and having a migration inducing electrical field thereacross. In general the invention involves: (i) forming a first image on the receiver electrode by exposing a layer of photoelectrophoretic imaging material within the imaging nip to a first light image and thereafter (ii) passing a copy sheet through the imaging nip and forming a second image on one side of the copy sheet, by means of a second light image exposure of photoelectrophoretic imaging material on the donor electrode, while transferring the first formed image from the receiver electrode to the other side of the copy sheet.

In one of the apparatus aspects of the present invention, the donor electrode is transparent and means are provided for synchronizing the copy-sheet-feed and image exposure means so that inception of the second image exposure and ingress of the copy sheet to the imaging nip coincide with movement of the leading edge surface of the first formed image (on its receiver electrode) into the nip.

BRIEF DESCRIPTION OF THE DRAWINGS

The subsequent description of preferred embodiments of the invention refers to the attached drawings wherein.

DETAILED DESCRIPTION OF THE PREFERRED EMBODIMENTS

Figure 1:
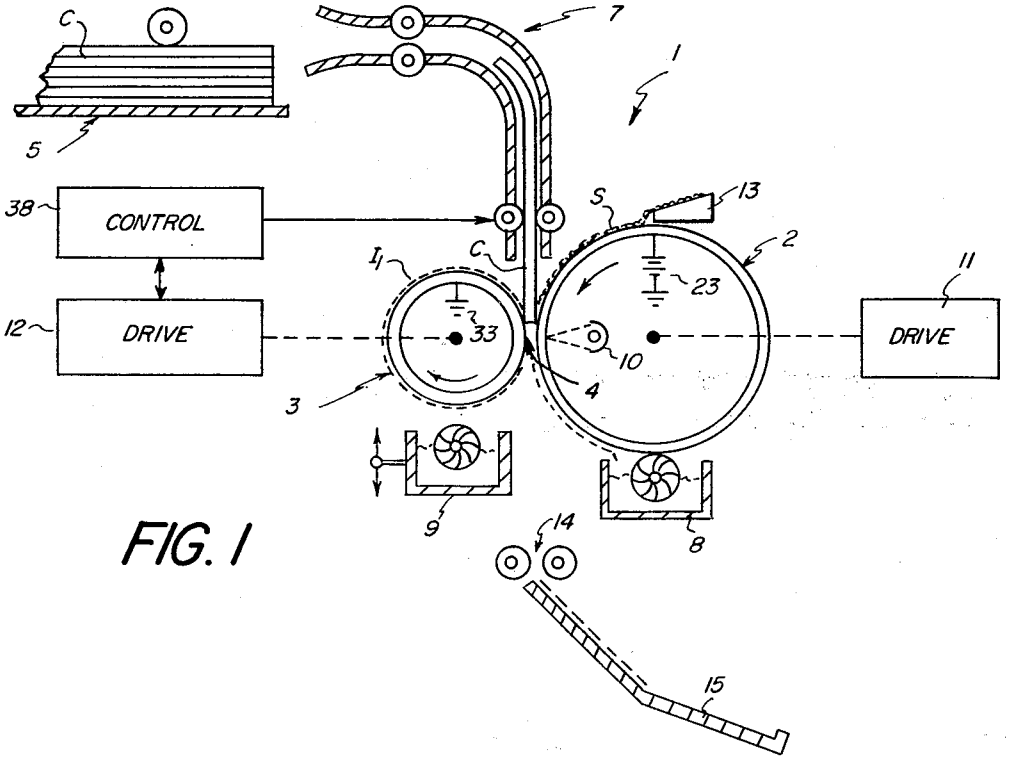
FIG. 1 is a schematic side view of one preferred embodiment of duplex photoelectrophoretic imaging apparatus in accord with the present invention.

The apparatus 1, shown in FIG. 1, in general comprises a cylindrical-drum, donor electrode means designated generally 2 and a cylindrical-drum, receiver electrode means designated 3. Other electrode forms, e.g. endless electrode webs rotatable around endless paths, can be used in an equivalent manner. Donor electrode means 2 is light transparent, and an illumination source 10 inside the electrode drum projects light through the donor electrode onto an imaging nip region 4 (formed between the donor and receiver electrode means).

From a supply 5 of copy sheets C, feed means 7 are provided to transport copy sheets through the imaging nip 4 in predetermined timed relation with other imaging operations, as hereinafter described in more detail. Cleaning stations 8 and 9, respectively, are provided for electrode means 2 and 3 at the positions shown in FIG. 1. Each electrode means is mounted for rotation about its central axis, and drive means 11 and 12 are provided to rotate the electrode means in the directions indicated at relative rotational speeds such that there is substantially zero relative velocity between peripheral surface portion thereof at the imaging nip 4. A slide hopper 13 provides a generally uniform layer of known photoelectrophoretic imaging suspension onto the surface of donor electrode means 2 at a location upstream from imaging nip 4. Fixing rollers 14 are located below the egress of the imaging nip to receive and fix images on both sides of an exiting copy sheet and forward the fixed copy sheet into an output bin 15.

Figure 2:
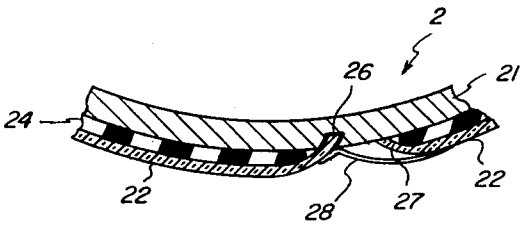
FIG. 2 is an enlarged cross-section of a portion of the donor electrode of the FIG. 1 apparatus.

The donor and receiver electrode means 2 and 3 are constructed to perform respectively injecting and blocking electrode functions as in conventional photoelectrophoretic imaging processes. Thus referring to FIGS. 2 and 3 as well as FIG. 1, it can be seen that the donor electrode 2 comprises a transparent cylinder 21, e.g. glass or plastic, having a transparent, electrically conductive overlayer 22. In the embodiment shown in FIG. 2, the overlayer 22 is in the form of a flexible, transparent plastic support having a thin transparent metal surface coating that is coupled to a source of potential 23 (FIG. 1). In this embodiment, image negatives 24 are sandwiched between cylinder 21 and electrode 22, and the exposure means 10 thus provides a flood exposure. One end 26 of the flexible support 22 is embedded in the cylinder 21 and the other end 27 is affixed e.g. by tape 28 after positioning of the negatives 24.

Figure 3:
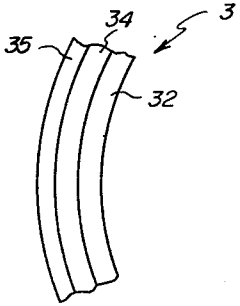
FIG. 3 is an enlarged cross-section of a portion of the receiver electrode of the FIG. 1 apparatus.

The receiver electrode 3 shown in FIG. 3 comprises an electrically conductive, e.g. metal, cylinder 32 coupled to a source of reference potential 33, e.g. ground (see FIG. 1). Overlying the cylinder 32 is a compliant layer 34 and an electrically insulative blocking electrode layer 35. In the disclosed embodiment the donor and receiver electrode means 2 and 3 are biased to provide a migration inducing electrical field such that particles of imaging suspension S (supplied on donor electrode 2 by hopper 13) when activated by light (from source 10 via negative 24) migrate to the blocking electrode surface 35 of receiver electrode means 3. Thus a reverse sense (i.e. positive) image of the image negative 24 migrates toward receiver electrode 3 and a same sense (i.e. negative) image migrates toward the donor electrode 2.

The operations of the FIG. 1 apparatus and function of control 38 which regulates it to provide duplex copies will now be described. In preparation for a reproduction sequence, two negatives 24 are inserted into the donor drum in proper orientation to provide right-reading images on opposite sides of a copy sheet. Apparatus 1 is then actuated, and, in the first portion of the duplex copy cycle, imaging material S is exposed to a first negative image 24 at the imaging nip without the presence of a copy sheet. This sequence forms a first suspension image $I_1$ on the receiver electrode means 3. During this portion of the reproduction cycle, the cleaning station 9 for receiver electrode 3 is moved to its lower, inoperative position shown in FIG. 1. During the next portion of the reproduction cycle, imaging material on the donor electrode 2 is exposed by light source 10, via the second negative image 24. In synchronization with this exposure a copy sheet C is fed from supply 5 into the imaging nip 4.

In the FIG. 1 embodiment, the relative sizes of cylinders 21 and 32, and the locations of negatives 24 on cylinder 21, are constructed so that the leading edge of the second negative enters the imaging nip 4 at the same time the leading edge of suspension image $I_1$ returns to the imaging nip. Thus the first suspension image $I_1$ is transferred to one side of the copy sheet while a second suspension image is formed directly on the opposite side of the copy sheet.

After the receiver electrode 3 completes its transfer to the copy sheet C and moves downstream to cleaning station 9, control 35 activates cleaning station 9 to its operative position in contact with receiver electrode 3 whereby residual material is removed from electrode 3 prior to its next pass through the imaging nip. Cleaning station 8 continuously removes the undesired image from donor electrode 2 so that a new suspension layer S can be provided prior to the second imaging passes of negatives 24.

After passing the imaging nip 4, the copy sheet C, bearing the desired suspension images on both sides, passes through fixing station 14 and into output hopper 15. This two-part cycle is continued until the desired number of duplex copies has been produced. The negatives then can be replaced for commencement of a different duplex copy.

Figure 4:
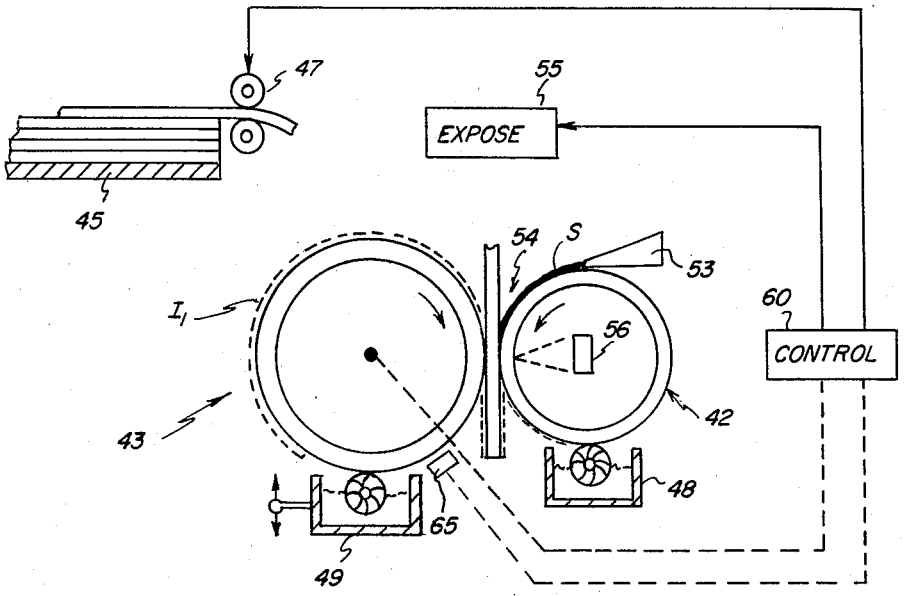
FIG. 4 is a schematic side view of an alternative preferred embodiment of duplex photoelectrophoretic imaging apparatus in accordance with the present invention.

An alternative embodiment of the present invention, adapted for more automated operation, is shown in FIG. 4. In this embodiment the receiver electrode means 43, copy sheet supply and feed means 45 and 47 and cleaning means 48 and 49 all can be as described with respect to FIG. 1. Also, fixing and output stations (not shown) like those of FIG. 1 are provided. As in the FIG. 1 embodiment, the receiver electrode 43 has a peripheral surface of length at least equal to the in-path dimension of a copy to be reproduced. However, as shown in FIG. 4, the peripheral length of donor electrode 42 of this embodiment need not be twice such in-path dimension.

Also, in the FIG. 4 embodiment the donor electrode means 42 comprises only a transparent conductive cylinder, i.e. flexible electrode 22 of FIG. 1 is not required. Thus the exposure by source 50 in this embodiment is an imagewise exposure directed at imaging nip 54 in a stripwise flowing manner, timed with movement of the electrode surfaces through the imaging nip. Such imagewise exposure can be effected either by scanning negatives with conventional scan optics or by electronic imaging means such as a laser or light valve array controlled by an appropriate video image signal. Such exposure means is indicated at 55, and in the FIG. 4 embodiment directs light image portions down the axis of the donor cylinder 42 and on toward the nip region via a mirror 56.

The operation of the FIG. 4 apparatus is similar to that of the FIG. 1 embodiment. Thus, control means 60 regulates drives (not shown) for donor and receiver electrodes 42, 43 to effect rotation in the directions indicated by arrows at speeds effecting a substantially zero relative velocity of their peripheral surface portions in the imaging nip region. In the first portion of the duplex copying cycle, exposure means 55 scans successive image portions, through transparent donor electrode 42, onto successive strips of the imaging suspension S supplied by dispensing means 53. The image is scanned onto the suspension, under control of control means 60, at the same rate as movement of the electrodes 42, 43 through the image nip. During the first portion of a reproduction cycle, a suspension image $I_1$ is formed on the donor electrode 43 (cleaning means 49 then being in its inoperative, down position). During the second portion of the reproduction cycle, copy sheet feed and the exposure of a second image are synchronized, by control means 60, so that inception of the second image exposure and movement of the leading copy sheet edge into the imaging nip coincide with movement into the imaging nip of the first formed image $I_1$ (on receiver electrode 43). Position sensing means 65 for drum 43 input synchronizing signals to control means 60. It will be appreciated that during this second portion of the imaging cycle the first formed image is transferred from electrode 43 to one side of the copy sheet C while a second image is formed on the opposite side of the copy sheet by exposure of imaging material newly applied to electrode 42. The exposure means 55 control the desired image sense and provide right-reading images on both sides.

The invention has been described in detail with particular reference to certain preferred embodiments thereof, but it will be understood that variations and modifications can be effected within the spirit and scope of the invention.

What is claimed is:

1. Photoelectrophoretic duplex imaging apparatus comprising:

(a) a generally cylindrical transparent electrode which is rotatable about its central axis and includes a peripheral surface;

(b) a generally cylindrical receiver electrode which is rotatable about its central axis to form an imaging nip with said transparent electrode and which comprises a peripheral surface with leading and trailing edge regions and a circumferential length at least equal to the along-path dimension of an image to be reproduced;

(c) means for rotating said electrodes in opposite directions at a rate providing substantially zero velocity between said peripheral surfaces at said imaging nip;

(d) means coupled to said electrodes for providing a migration inducing electrical field across said imaging nip;

(e) means for supplying photoelectrophoretic imaging suspension on said transparent electrode surface rotated through said imaging nip;

(f) means for sequentially directing successive portions of a first and then a second light image to said imaging nip;

(g) means for feeding a copy sheet through said imaging nip; and (h) means for synchronizing said sheet feeding and exposing means so that inception of said second image exposure and movement of said copy sheet into said imaging nip coincide with movement of said receiver electrode's leading edge region into said nip, whereby a first suspension image corresponding to said first light image is first formed on said receiver electrode and, subsequently, said first suspension image is transferred to one side of said copy sheet while a second suspension image corresponding to said second light image is formed on the opposite side of said copy sheet.

2. Photoelectrophoretic duplex imaging apparatus comprising:

(a) a generally cylindrical transparent electrode rotatable on its central axis and having first and second imaging zones of approximately equal length at successive locations on its peripheral surface;

(b) a generally cylindrical receiver electrode rotatable on its central axis to form an imaging nip with said transparent electrode and having a peripheral surface approximately equal in length to said first imaging zone of said transparent electrode;

(c) means for rotating said electrodes in opposite directions at a rate providing substantially zero relative velocity between said peripheral surface portions at said imaging nip;

(d) means coupled to said electrodes for providing a migration inducing electrical field across said imaging nip;

(e) means located upstream of said imaging nip for supplying photoelectrophoretic imaging suspension on the surface of said transparent electrode;

(f) means for directing successive portions of a first light image to said imaging nip as respective portions of said transparent electrode's first imaging zone move therepast and for exposing successive portions of a second light image at said imaging nip as respective portions of said transparent electrode's second imaging zone move therepast; and (g) means for feeding a copy sheet through said imaging nip in synchronization with the passage of said second imaging zone, whereby a suspension image corresponding to said first light image is formed on said receiver electrode during passage of said first imaging zone through said nip and, during passage of said second imaging zone through said nip, said first suspension image is transferred to one side of said copy sheet while a suspension image corresponding to said second light image is formed on the opposite side of said copy sheet.

3. In apparatus for photoelectrophoretic imaging and which includes: (1) first and second electrodes which are movable along respective endless paths and cooperatively form an imaging nip, (2) means forming a migration inducing electrical field across said nip and (3) means for supplying photoelectrophoretic imaging suspension at said nip, the improvement comprising:

(a) means for forming a first suspension image on said second electrode, by first-image light exposure of a layer of photoelectrophoretic imaging material at said nip, and for moving said first suspension image back through said nip;

(b) means for feeding a copy sheet through said nip in timed relation with the movement of said first suspension image into said nip; and (c) means for forming a second image on one side of said copy sheet, by means of a second-image light exposure of a layer of photoelectrophoretic imaging material at said nip, while transferring said first formed image from said second electrode to the other side of said copy sheet.

4. A method of photoelectrophoretic duplex imaging with first and second electrodes which are movable along respective endless paths and form an imaging nip with a migration inducing electrical field thereacross, said method comprising:

(a) forming a first image on said second electrode by means of a first-image light exposure of a layer of photoelectrophoretic imaging material at said nip; and (b) feeding a copy sheet through said nip and forming a second image on one side of a copy sheet, by means of a second-image exposure of a layer of photoelectrophoretic imaging material at said nip, while transferring said first formed image from said second electrode to the other side of said copy sheet.

* * * * *